United States Patent [19]

Schüssler et al.

[11] Patent Number: 4,946,628

[45] Date of Patent: Aug. 7, 1990

[54] LIQUID DETERGENTS WHICH CONTAIN STILBENE WHITENERS

[75] Inventors: Ulrich Schüssler, Leverkusen; Florin Seng, Bergisch-Gladbach, both of Fed. Rep. of Germany

[73] Assignee: Bayer Aktiengesellschaft, Leverkusen, Fed. Rep. of Germany

[21] Appl. No.: 219,685

[22] Filed: Jul. 15, 1988

[30] Foreign Application Priority Data

Aug. 7, 1987 [DE] Fed. Rep. of Germany ..... 3726266

[51] Int. Cl.[5] ..... C11D 3/42

[52] U.S. Cl. ..... 252/543; 252/524; 252/DIG. 14; 252/174.21

[58] Field of Search ..... 252/543, DIG. 14, 545, 252/524, 301.23

[56] References Cited

U.S. PATENT DOCUMENTS

| | | | |
|---|---|---|---|
| 3,632,491 | 1/1972 | Zussman et al. | 252/524 |
| 3,684,728 | 8/1972 | Kissling et al. | 252/301.23 |
| 3,700,601 | 10/1972 | Bloching et al. | 252/105 |
| 4,233,167 | 11/1980 | Sramek | 252/8.75 |
| 4,717,502 | 1/1988 | Schmid | 252/301.23 |

FOREIGN PATENT DOCUMENTS 2187749 9/1987 United Kingdom .

*Primary Examiner*—Prince E. Willis
*Attorney, Agent, or Firm*—Sprung Horn Kramer & Woods

[57] ABSTRACT

Liquid detergents which contain stilbene compounds of the formula

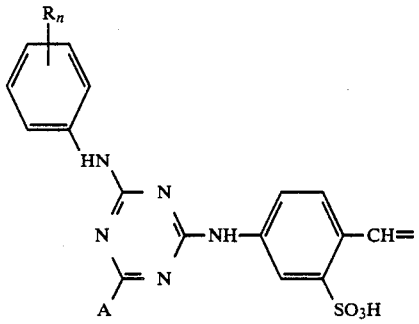

(I)

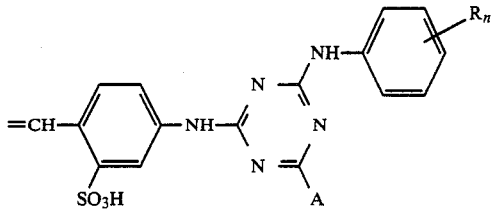

as whiteners in which

A denotes

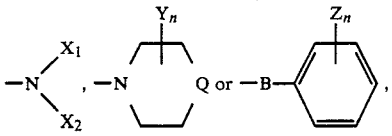

B denotes O, NH, NY or $NH(CH_2)_n$

R denotes H, $C_1$–$C_4$-alkoxy, $C_1$–$C_4$—O—alkoxy, F, Cl, $CF_3$ or $OCF_3$ $X_1$ denotes $C_4$–$C_{12}$-alkyl or $C_5$–$C_7$-cycloalkyl $X_2$ denotes H or $C_1$–$C_{12}$-alkyl Q denotes —O—, —$CH_2$—, —$CH_2CH_2$— or denotes a direct bond, Y denotes $C_1$–$C_4$-alkyl Z denotes R n denotes 1, 2 or 3 with the proviso that, if Z is H and B is NH, R is not H, are distinguished by improved "spotting".

9 Claims, No Drawings

LIQUID DETERGENTS WHICH CONTAIN STILBENE WHITENERS

The present invention relates to liquid detergents containing whiteners and having improved properties with respect to the formation of whitener spots ("spotting").

In the detergent sector, this phenomenon is understood to mean the undesirable spotting by whitener on an unbleached white or pastel coloured textile material upon direct contact with a whitener-containing liquid detergent, as is the case, for example, in the local treatment of a dirt spot with such an agent. This spot caused by the high concentration of the whitener in the undiluted detergent is not or only incompletely removed or compensated in a subsequent washing step with the same liquid detergent.

It has therefore already been proposed (cf. US 4,559,169=EP 167,205) to mix incorporate in the liquid detergents not the di- or polysulphonated whiteners which are distinguished by high substantivity but the whitener-monosulphonic acids of less affinity for the fibre.

Although a reduced tendency for spotting is actually obtained in this manner, this advantage is, on the other hand, achieved at the expense of a smaller total white effect on the material to be brightened.

Surprisingly, it has now been found that whitener-containing liquid detergents having improved "spotting" properties and, at the same time, good brightening action are obtained, if the whitener used are those compounds which, in the form of the free acid, correspond to the formula

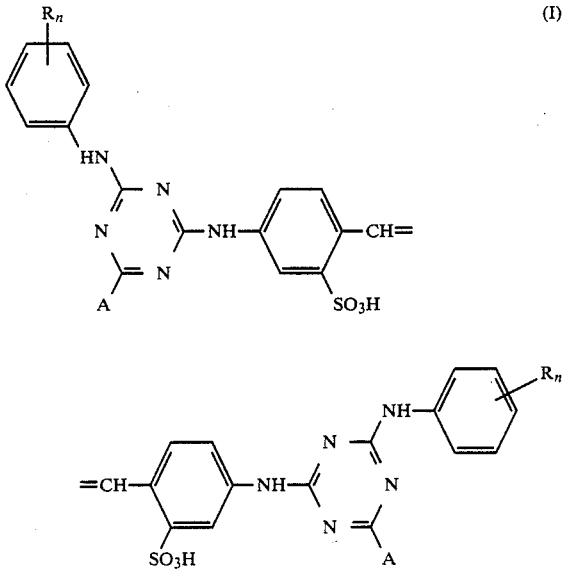

(I)

in which independently of each other

A denotes

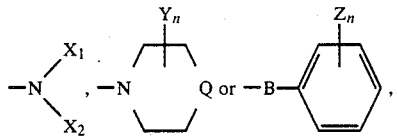

B denotes O, NH, NY or $NH(CH_2)_n$

R denotes H, $C_1$–$C_4$-alkoxy, $C_1$–$C_4$—O—alkoxy, F, Cl, $CF_3$ or $OCF_3$ $X_1$ denotes $C_4$–$C_{12}$-alkyl or $C_5$–$C_7$-cycloalkyl $X_2$ denotes H or $C_1$–$C_{12}$-alkyl Q denotes —O—, —$CH_2$—, —$CH_2CH_2$— or denotes a direct bond, Y denotes $C_1$–$C_4$-alkyl Z denotes R n denotes 1, 2 or 3 with the proviso that, if Z is H and B is NH, R is not H.

Preferably, the $C_1$–$C_4$-alkyl radicals mentioned stand for $C_2H_5$ and in particular $CH_3$, while the higher alkyl radicals $X_1$ stand especially for n-butyl to n-hexyl.

Cycloalkyl can be in particular cyclohexyl.

Whiteners preferably to be used are those of the formula (I) in which B is not equal to NH or NY.

Particular preference is given to those compounds of this formula in which

R denotes H and

A denotes

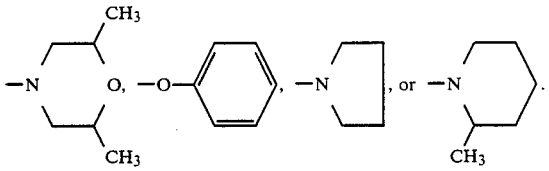

These whiteners not only have good properties for practical use, but are also very readily accessible.

Of course, the compounds of the formula I can also be present in the form of their salts, in particular alkali metal, amine and ammonium salts. Suitable alkali metal salts are the Na, Li or K salts.

The whiteners of the formula (I) are known (cf. DE-A 1,545,920 C.A. 101 (1984) 1,980,840y) or are accessible by methods known per se by reacting, for example, compounds of the formula

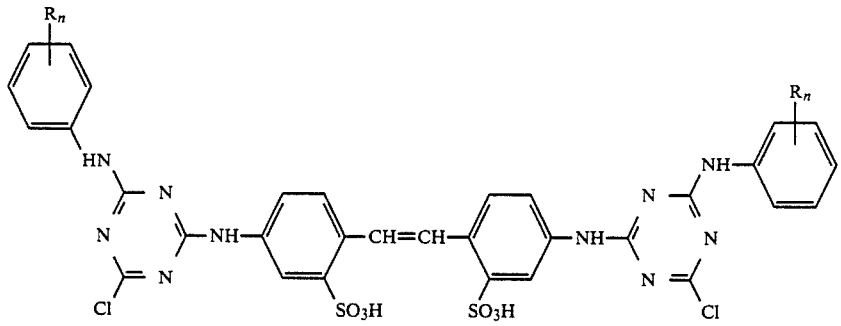

(II)

with compounds of the formula A—H—preferably in the presence of an acid acceptor.

The liquid detergents can be divided into the following classes with respect to the surfactant systems used:

(a) combined anionic/nonionic
(b) combined anionic/nonionic/cationic
(c) combined nonionic/cationic
(d) combined anionic/nonionic+builder
(e) pure nonionic.

In the context of this invention, systems (a), (b), (d) and (e) are preferred.

Suitable surfactants are described in US Patent Specification No. 4,559,169, columns 2–4.

Preferred nonionic surfactants can be commercial products, for example the addition products of ethylene oxide with higher aliphatic alcohols and alkylphenols, acids such as higher fatty acids, resin acids, tall oil acids and acids of the oxidation products of petroleum and also alkylene oxide adducts of higher amides of fatty acids, the fatty acid component generally having 8 to 22 C atoms and being condensed with 10 to 50 mol of ethylene oxide.

Preferred anionic surfactants are fatty alcohol sulphates and alkylbenzenesulphonates and also fatty acids as described in US 4,559,169, column 6.

Suitable builder-containing detergents are described in GB 2,028,365. Preferred builders are phosphates, NTA, citrates and polycarboxylates.

The liquid medium for the detergents according to the invention is aqueous and can consist of water by itself or of water and additional solvents as solubilizing agents. The additional solvents can constitute up to 20, preferably up to 15%, of the entire solvent content. They can be: lower alkanols or a lower diol or polyol.

The liquid detergent according to the invention can moreover contain conventional additives such as soil anti-redeposition agents or greyness inhibitors, anti-foams, preservatives and scents. Of course, these agents are selected such that they are compatible with the main components of the detergent.

The whiteners to be used according to the invention are added independently of the surfactant system in amounts of 0.005 to 1% or more, based on the weight of the detergent. The detergents according to the invention can be used in soft or hard water at temperatures from 10° to 60° C. and above.

The washing treatment is carried out, for example, as follows: the textiles are treated in a washing bath containing 0.1 to 10 g/kg of the detergent for 1 to 30 minutes at 20° to 100° C. The liquor ratio can be 3:1 to 50:1.

In the following examples, the percentages are by weight.

EXAMPLES

In a liquid detergent of type (d) consisting of 12.5% of coconut soap
8.5% of linear alkylbenzenesulphonate
5.5% of $C_{12-15}$-fatty alcohol ethoxylate (7 EO)
7.5% of potassium citrate
5.0% of propylene glycol
8.5% of ethanol
1.0% of Na formate
13.5% of $C_{12-14}$-fatty alcohol ether sulphate made up to 100.0% with fully deionized water the whiteners listed in the following table were dissolved:

TABLE

| Whitener of the formula (I) | | | | |
|---|---|---|---|---|
| No. | R | A | CIE whiteness | Spotting |
| 1 | H | 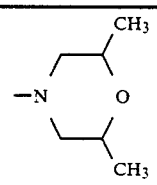 | 121 | + |
| 2 | H | 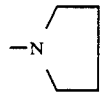 | 118 | + |
| 3 | H | 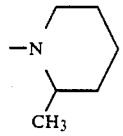 | 115 | O |
| 4 | H | 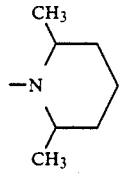 | 97 | O |
| 5 | H | 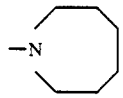 | 102 | O |
| 6 | H | 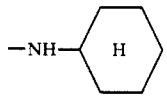 | 99 | O |

TABLE-continued

| No. | R | Whitener of the formula (I) A | CIE whiteness | Spotting |
|---|---|---|---|---|
| 8 | m-$CF_3$ | 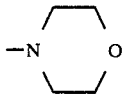 | 118 | O |
| 9 | p-$OCF_3$ | 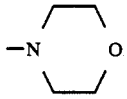 | 120 | O |
| 10 | H | 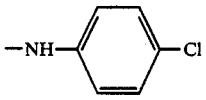 | 110 | O |
| 11 | H | 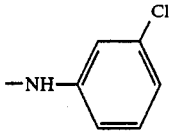 | 109 | O |
| 12 | H | 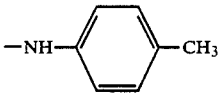 | 111 | O |
| 13 | H | 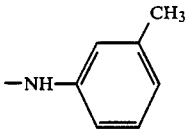 | 110 | O |
| 14 | H | 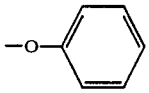 | 120 | O |
| 15 | H | 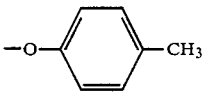 | 108 | O |
| 16 | H | 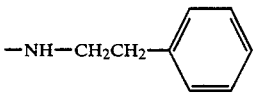 | 109 | O |
| 17 | m-$CF_3$ | 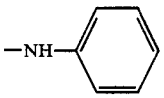 | 102 | O |
| 18 | p-$CF_3$ | 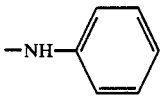 | 101 | O |
| 19 (comparison) | H | 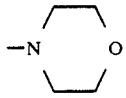 | 120 | ++ |

The detergents thus obtained were used to carry out washing experiments:

| | |
|---|---|
| Material | bleached cheesecloth |
| Dosage | 5 g/l |
| Liquor ratio | 20:1 |
| Temperature | 50° C. |
| Water hardness | 6° German hardness |

After 9 washes, the whiteness of the cheesecloth was determined with a colorimeter (RFC 3, from Zeiss Co.) and calculated using the CIE formula.

"Spotting" of the liquid detergent on the unwashed textile was tested as follows:

1 ml of the liquid detergent was applied to 20 g of the test specimen (bleached cheesecloth), standard white (CIE=78). After an exposure time of 20 minutes, the test specimen was washed once at 50° C. in a washing liquor of 5 g/l of the same detergent. The whitener spot was evaluated by using a UV lamp.

0=no spot
+=slight spot
++=severe spot)

We claim:

1. A whitener-containing liquid detergent which comprises a liquid detergent and a whitener, said whitener being a compound of the formula (I)

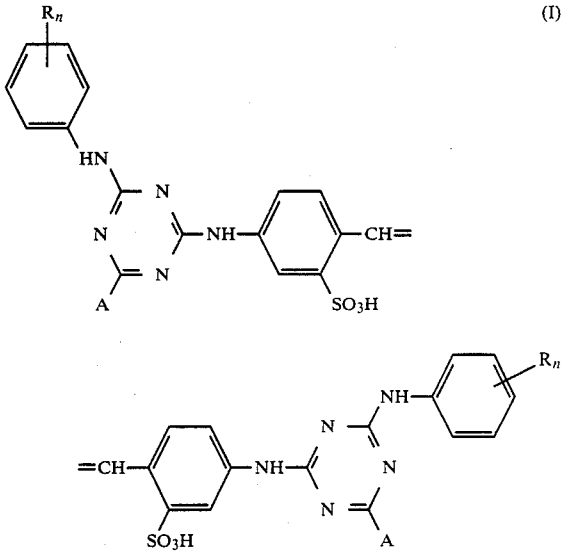

in which independently of each other

A denotes

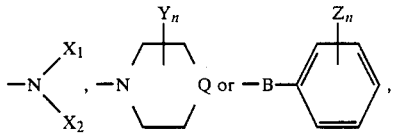

B denotes O, NH, NH, or $NH(CH_2)_n$,

R denotes H, $C_1$–$C_4$ alkyl, $C_1$–$C_4$—O alkoxy, F, Cl, $CF_3$ or $OCF_3$, $X_1$ denotes $C_4$–$C_{12}$ alkyl or $C_5$–$C_7$ cycloalkyl, $X_2$ denotes H or $C_1$–$C_{12}$ alkyl, Q denotes —O—, —$CH_2$—, —$CH_2CH_2$— or denotes a direct bond, Y denotes $C_1$–$C_4$ alkyl,
Z denotes R and
n denotes 1, 2 or 3,
with the proviso that, if Z is H and B is NH, R is not H, and alkali metal, amine and ammonium salts of said compound.

2. A liquid detergent according to claim 1, wherein the whitener contained therein corresponds to the formula mentioned in which
R denotes H and
A denotes

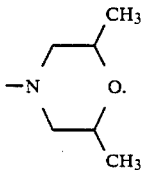

3. A liquid detergent according to claim 1, wherein the whitener contained therein corresponds to the formula mentioned in which
R denotes H and
A denotes

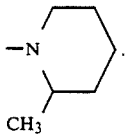

4. A liquid detergent according to claim 1, wherein the whitener contained therein corresponds to the formula mentioned in which
R denotes H and
A denotes

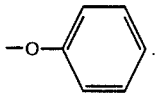

5. A liquid detergent according to claim 1, wherein
R is H and
A is

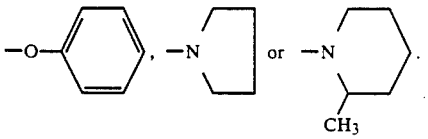

6. A liquid detergent according to claim 1, wherein the alkali metal salt is Na, Li or K salt.

7. A liquid detergent according to claim 1, wherein the whitener is added in an amount of 0.005 to 1% or more, based on the weight of the detergent.

8. A whitener-containing liquid detergent according to claim 1, wherein
A is

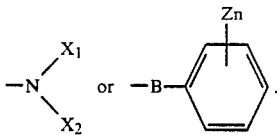

9. A whitener-containing liquid detergent according to claim 1, wherein R is $C_1$–$C_4$ alkyl, $C_1$–$C_4$—O alkoxy, F, Cl, $CF_3$ or $OCF_3$.

* * * * *